US007913354B2

(12) United States Patent
Tashima et al.

(10) Patent No.: US 7,913,354 B2
(45) Date of Patent: Mar. 29, 2011

(54) AUTOMOBILE DOOR CHECKER

(75) Inventors: Yuujiro Tashima, Wako (JP); Hidetoshi Ijuin, Wako (JP); Yasuhiko Yoshida, Wako (JP); Yuji Murayama, Sakado (JP); Yuji Arie, Sakado (JP)

(73) Assignees: Honda Motor Co., Ltd., Tokyo (JP); Rikenkaki Kogyo Kabushiki Kaisha, Saitama (JP)

( * ) Notice: Subject to any disclaimer, the term of this patent is extended or adjusted under 35 U.S.C. 154(b) by 215 days.

(21) Appl. No.: 11/922,863

(22) PCT Filed: Jul. 13, 2006

(86) PCT No.: PCT/JP2006/313946

§ 371 (c)(1),
(2), (4) Date: Jan. 23, 2009

(87) PCT Pub. No.: WO2007/010811

PCT Pub. Date: Jan. 25, 2007

(65) Prior Publication Data

US 2009/0217592 A1 Sep. 3, 2009

(30) Foreign Application Priority Data

Jul. 15, 2005 (JP) ..... 2005-207481

(51) Int. Cl.
*E05C 17/22* (2006.01)
*E05F 5/02* (2006.01)

(52) U.S. Cl. ..... 16/86 C; 16/86 B

(58) Field of Classification Search ..... 16/85, 86 C, 16/86 R, 86 B; 292/265, 262, 269, 336.3, 292/338

See application file for complete search history.

(56) References Cited

U.S. PATENT DOCUMENTS 2,268,976 A * 1/1942 Westrope ..... 16/86 C
4,788,743 A * 12/1988 Okumura ..... 16/82
7,143,473 B2 * 12/2006 Matsuki ..... 16/86 C

FOREIGN PATENT DOCUMENTS

DE 196 14713 A1 10/1997

(Continued)

*Primary Examiner* — Chuck Y. Mah

(74) *Attorney, Agent, or Firm* — Carrier Blackman & Associates, P.C.; William D. Blackman; Joseph P. Carrier

(57) ABSTRACT

An automobile door checker includes a case secured to a door, a check plate that runs movably through the case and is pivotably supported on a body, a detent member fitted into and retained by the case and working in cooperation with a detent face of the check plate, and a resilient member that is made of a resilient material and is provided in a compressed state in a housing chamber defined between an outer end face of the detent member and an inner end face of the case, wherein the resilient member is formed so that it substantially fills the housing chamber, the resilient member is provided with a hole portion that allows resilient deformation of the resilient member, the hole portion being sealed by the outer end face and the inner end face, and a half of the resilient member on the outer end face side and a half on the inner end face side are symmetrical. In this way, even if some rainwater that has infiltrated into the housing chamber of the case housing the resilient member freezes, it is possible to prevent the resilient deformation characteristics of the resilient member from changing, and it is also possible to avoid misassembly of the resilient member.

4 Claims, 5 Drawing Sheets

FOREIGN PATENT DOCUMENTS

| | | | | |
|---|---|---|---|---|
| DE | 299 05318 | U1 | | 8/1999 |
| FR | 2 852 995 | A1 | | 10/2004 |
| JP | 57-124568 | | | 8/1982 |
| JP | 60-155698 | | | 10/1985 |
| JP | 62-63370 | | | 4/1987 |
| JP | 62-63371 | | | 4/1987 |
| JP | 1-30514 | | | 9/1989 |
| JP | 2- 77338 | | | 6/1990 |
| JP | 5-201254 | | | 8/1993 |
| JP | 7145839 | | | 6/1995 |
| JP | 3017041 | | | 8/1995 |
| JP | 08210005 | A | * | 8/1996 |
| JP | 08244457 | A | * | 9/1996 |
| JP | 09177410 | A | * | 7/1997 |
| JP | 09-256714 | | | 9/1997 |
| JP | 10331502 | A | * | 12/1998 |
| JP | 11-241546 | | | 9/1999 |
| JP | 2001-105863 | | | 4/2001 |
| JP | 2001-349122 | | | 12/2001 |
| JP | 2004-190431 | | | 7/2004 |

* cited by examiner

AUTOMOBILE DOOR CHECKER

CROSS-REFERENCE TO RELATED APPLICATIONS

The present application is a U.S. National phase of, and claims priority based on PCT/JP2006/313946 filed 13 Jul. 2006, which, in turn, claims priority from Japanese patent application 2005-207481, filed 15 Jul. 2005. The entire disclosure of each of the referenced priority documents is incorporated herein by reference.

TECHNICAL FIELD

The present invention relates to an improvement of an automobile door checker that includes a case secured to one of an automobile body and a door pivotably supported on the automobile body, a check plate that runs movably through the case and is coupled to the other one of the body and the door, a detent member slidably fitted into and retained by the case so as to retain the door at a predetermined open position in cooperation with a detent face of the check plate, and a resilient member that is made of a resilient material, is provided in a compressed state in a housing chamber defined between an outer end face of the detent member on a side opposite to the check plate and an inner end face of the case opposite this outer end face, and generates a detent force between the detent member and the detent face.

BACKGROUND ART

Such a door checker is already known, as disclosed in Patent Publication 1. Patent Publication 1: Japanese Patent Application Laid-open No. 9-256714

DISCLOSURE OF INVENTION

Problems to be Solved by the Invention

In such a conventional automobile door checker, since a space for allowing the resilient member to resiliently deform is provided between an outer face of the resilient member and the inner face of the case, rainwater might infiltrate into this space by moving along the check plate, etc., and if the rainwater freezes, the resilient deformation characteristics of the resilient member change, thus causing an uncomfortable sensation when opening and closing the door.

Accordingly, an arrangement is known in which the case or the check plate is covered by a waterproof cover to thus prevent rainwater from infiltrating into the case, but even in such an arrangement it is impossible to make the interior of the case completely watertight, the number of components increases, and the cost becomes high.

The present invention has been accomplished in the light of such circumstances, and it is an object thereof to provide an automobile door checker of the above type that as far as possible prevents rainwater from infiltrating into a housing chamber for a resilient member and that, even if some rainwater that has infiltrated freezes, prevents the resilient deformation characteristics of the resilient member from changing, thus avoiding the occurrence of an uncomfortable sensation when opening and closing a door.

SUMMARY OF THE INVENTION

In order to attain the above object, according to a first aspect of the present invention, there is provided an automobile door checker comprising a case secured to one of an automobile body and a door pivotably supported on the automobile body, a check plate that runs movably through the case and is coupled to the other one of the body and the door, a detent member slidably fitted into and retained by the case so as to retain the door at a predetermined open position in cooperation with a detent face of the check plate, and a resilient member that is made of a resilient material, is provided in a compressed state in a housing chamber defined between an outer end face of the detent member on a side opposite to the check plate and an inner end face of the case opposite the outer end face, and generates a detent force between the detent member and the detent face, characterized in that the resilient member is formed so as to substantially fill the housing chamber, the resilient member is provided with a hole portion that allows resilient deformation of the resilient member, the hole portion being sealed by the outer end face and the inner end face, and one half of the resilient member on the outer end face side and the other half on the inner end face side are symmetrical.

Further, according to a second aspect of the present invention, in addition to the first aspect, the resilient member is provided with a dividing wall for dividing the hole portion into two portions that are blocked from each other.

Moreover, according to a third aspect of the present invention, in addition to the first or second aspect, annular seal lips are formed on the outer face of the resilient member, the annular seal lips surrounding an open end of the hole portion and being in intimate contact with the outer end face or the inner end face.

Furthermore, according to a fourth aspect of the present invention, in addition to any one of the first to third aspects, the hole portion is formed so as to have a circular cross-section.

Furthermore, according to a fifth aspect of the present invention, in addition to the first aspect, a left half of the resilient member on a left inside face side of the case and a right half on a right inside face side of the case are symmetrical.

EFFECTS OF THE INVENTION

In accordance with the first aspect of the present invention, since the resilient member can be formed so as to substantially fill the housing chamber within the case, it is possible to prevent as far as possible rainwater from infiltrating into the housing chamber.

Moreover, since the resilient member is provided with the hole portion for allowing its resilient deformation so that the hole portion is sealed by the outer end face and the inner end face, even if some rainwater infiltrates into the housing chamber and freezes, resilient deformation of the resilient member is allowed as normal within the sealed hole portion, the resilient deformation characteristics of the resilient member therefore do not change, and the good opening and closing feel of the door can always be maintained.

Furthermore, since the hole portion opens on the outer face of the resilient member, this can be easily formed using a mold when molding the resilient member.

Moreover, since one half of the resilient member on the outer end face side and the other half thereof on the inner end face side are symmetrical, when fitting the resilient member into the housing chamber, it is unnecessary to restrict the direction of the resilient member with respect to the outer end face and the inner end face, the ease of assembly is good, and it is consequently possible to not only avoid misassembly but also for the proper function of the resilient member to always be exhibited.

In accordance with the second aspect of the present invention, even if rainwater infiltrates into one half of the hole portion divided by the dividing wall and freezes, resilient deformation of the resilient member can be allowed in the other half of the hole portion, which is free from the infiltration of rainwater, thus enhancing the reliability.

In accordance with the third aspect of the present invention, since the annular seal lip is formed on the outer face of the resilient member so as to surround the open end of the hole portion and is in intimate contact with the outer end face or the inner end face, it is possible to reliably prevent rainwater from infiltrating into the hole portion, thus further enhancing the reliability.

In accordance with the fourth aspect of the present invention, since the hole portion of the resilient member has a circular cross-section, when the resilient member undergoes compressive deformation, stress occurring on the inner peripheral wall of the hole portion can be equalized, thus contributing to an improvement in the durability of the resilient member.

In accordance with the fifth aspect of the present invention, it is unnecessary to restrict the direction of the resilient member in either the vertical direction or the lateral direction when fitting the resilient member into the housing chamber, thus still further improving the ease of assembly.

The above-mentioned object, other objects, features, and advantages of the present invention will become apparent from an explanation of a preferred embodiment described in detail below by reference to the attached drawings.

EXPLANATION OF REFERENCE NUMERALS AND SYMBOLS

Figure 1:
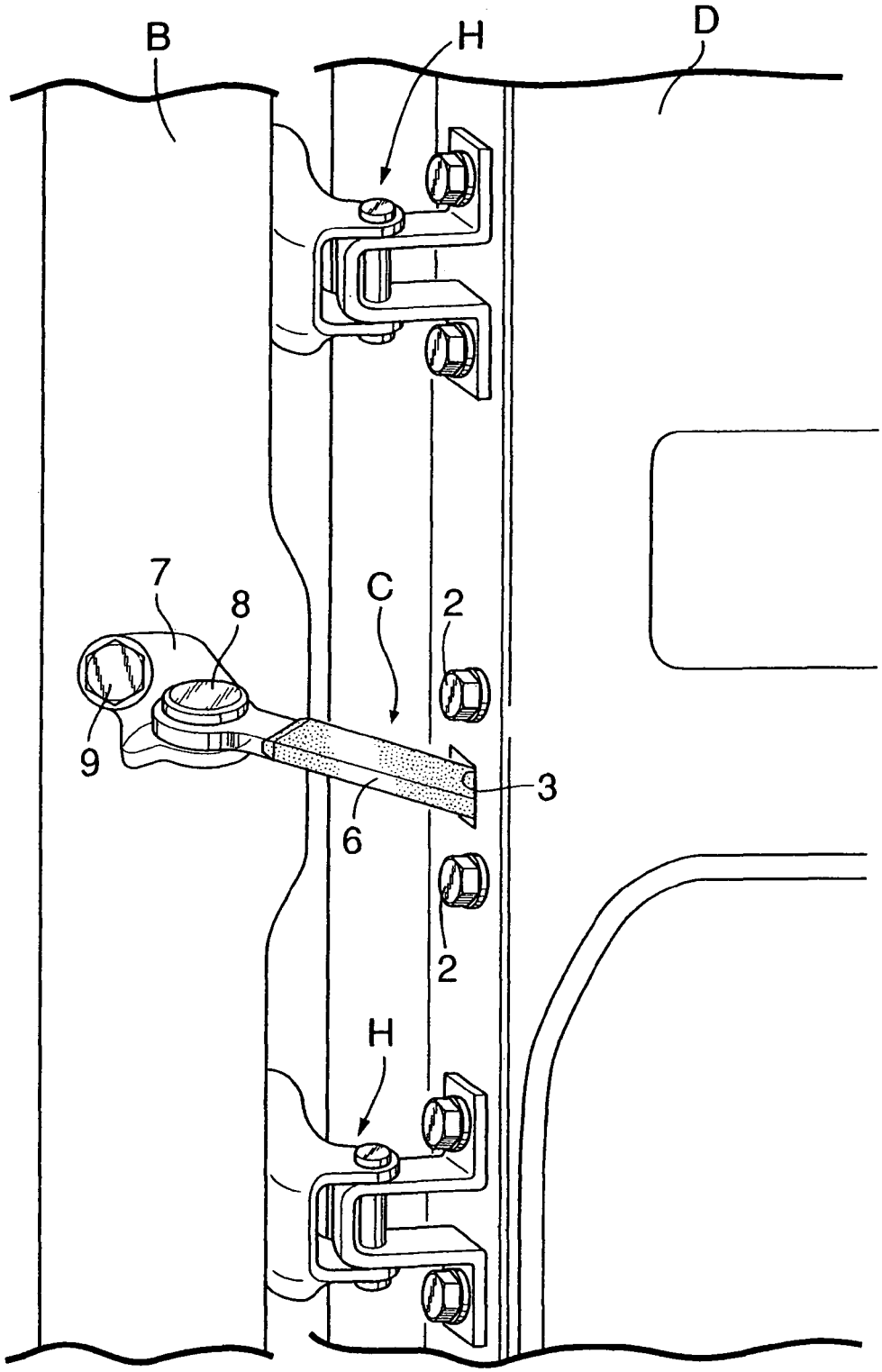
FIG. 1 is a perspective view of an essential part of an automobile on which the door checker of the present invention is mounted (first embodiment).
Figure 2:
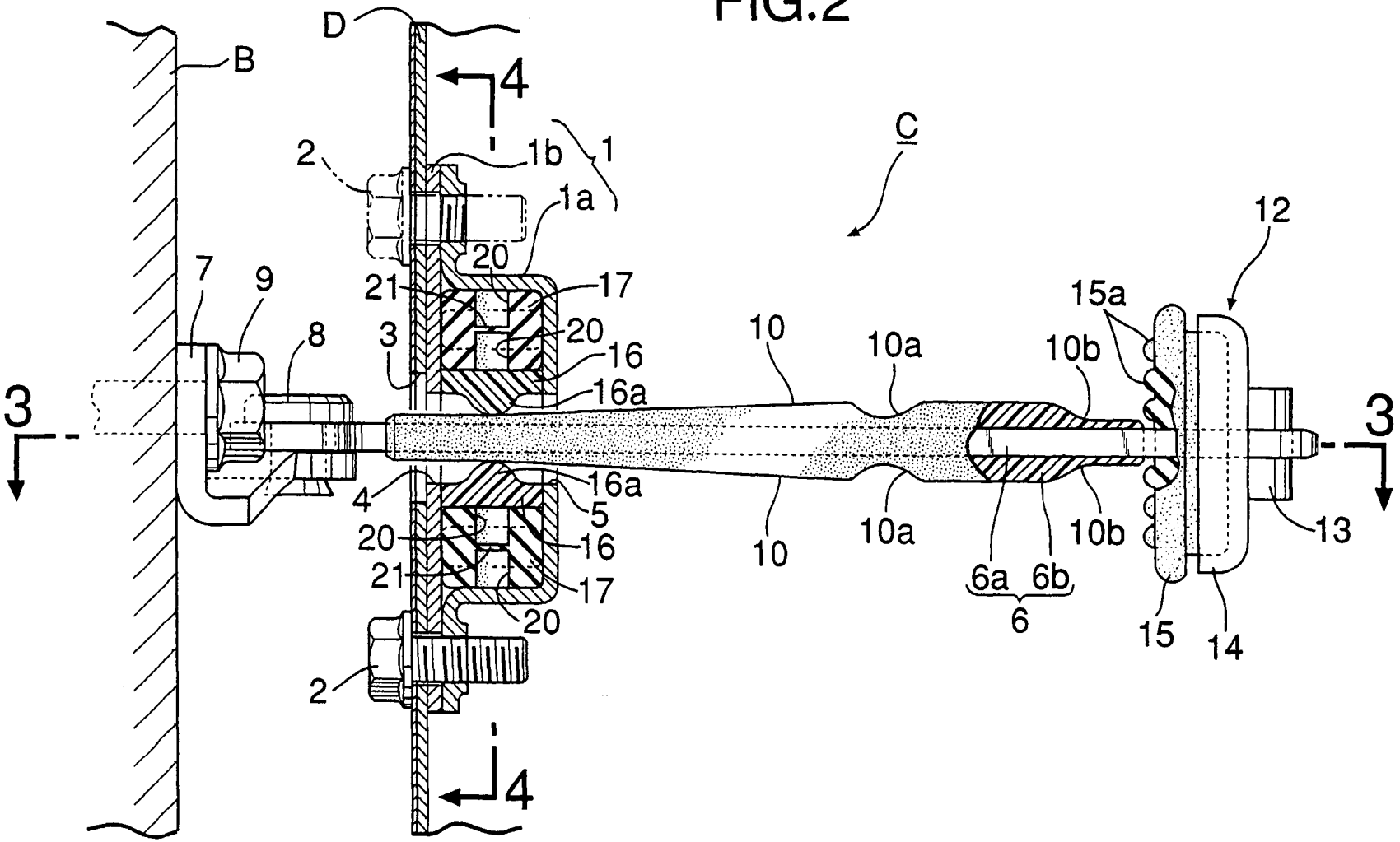
FIG. 2 is a side view in which an essential part of the door checker is vertically sectioned (first embodiment).
Figure 3:
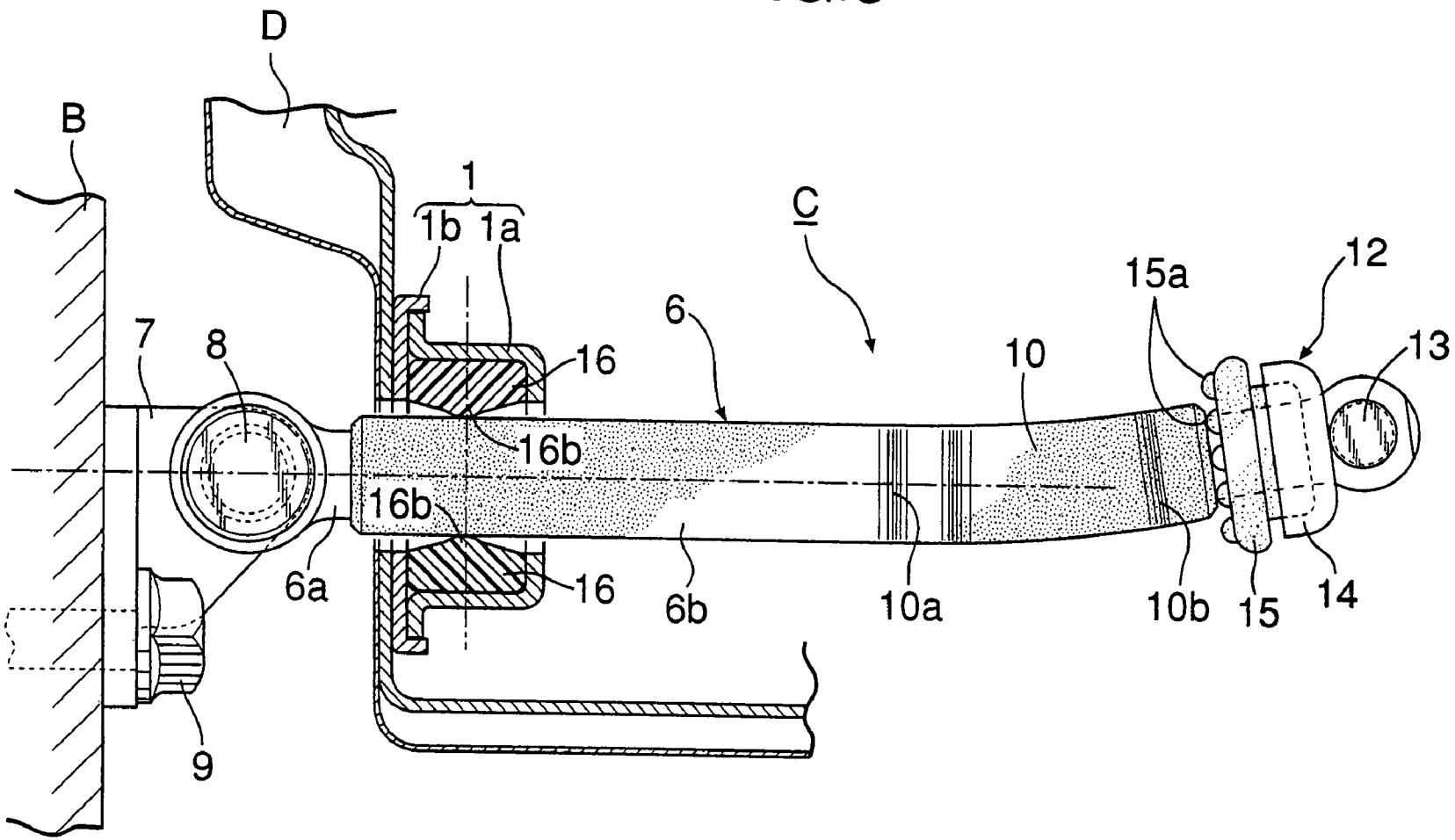
FIG. 3 is a sectional view along line 3-3 in FIG. 2 (first embodiment).
Figure 4:
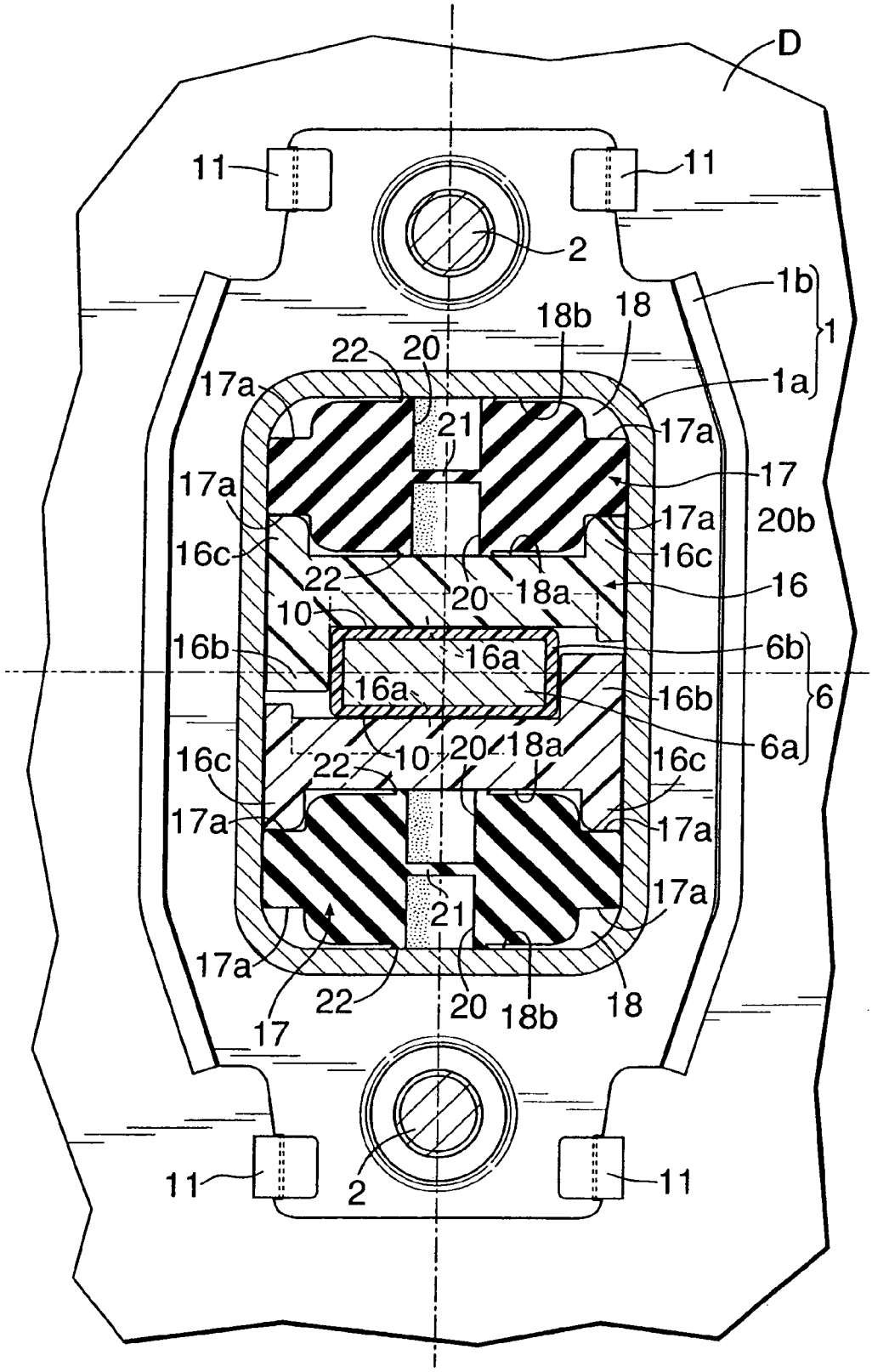
FIG. 4 is an enlarged sectional view along line 4-4 in FIG. 2 (first embodiment).
Figure 5:
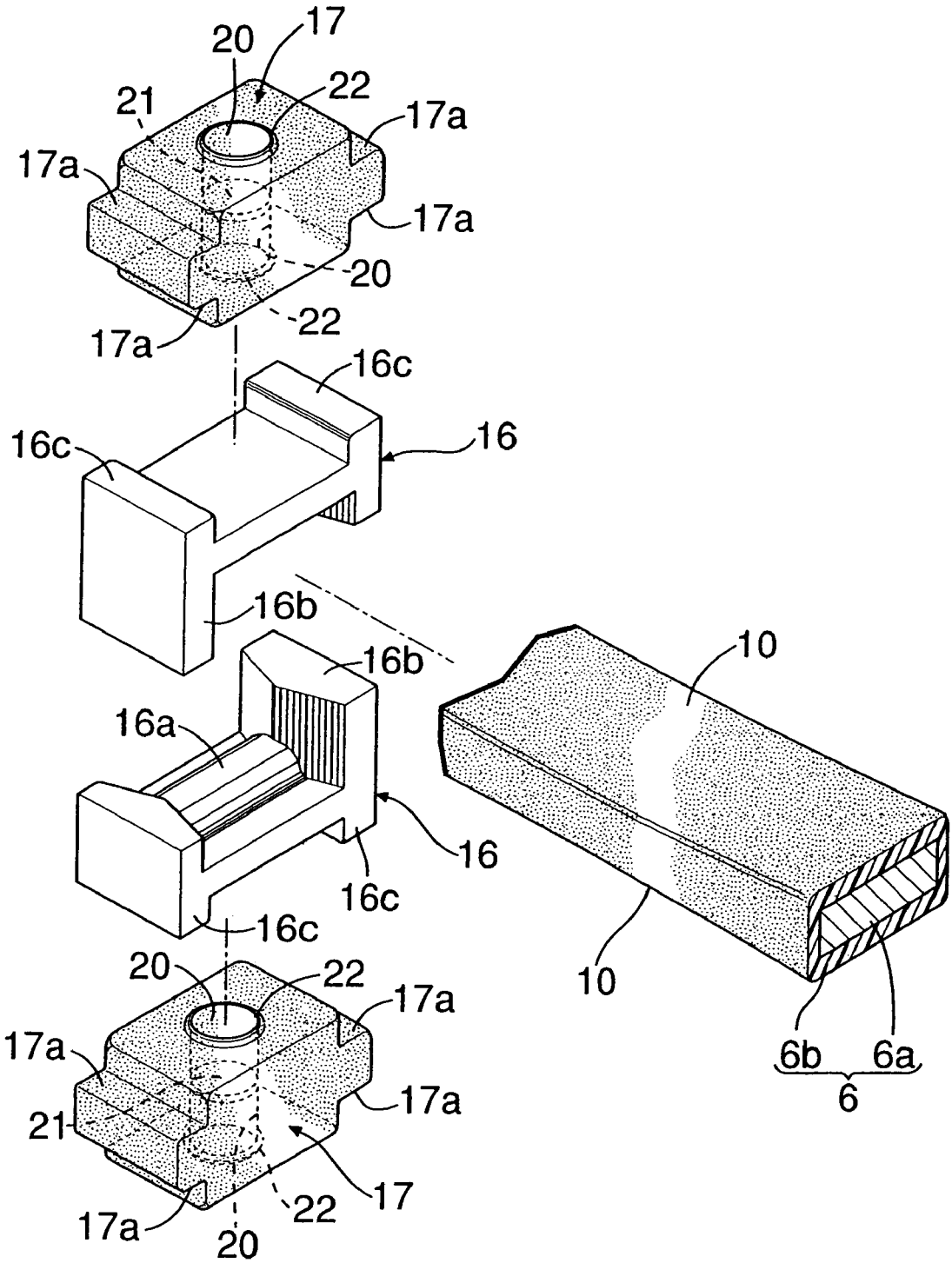
FIG. 5 is an exploded perspective view of an essential part of the door checker (first embodiment).

B Body
C Door checker
D Door
1 Case
6 Check plate
10 Detent face
16 Detent member
17 Resilient member
18 Housing chamber
18*a* Detent member outer end face
18*b* Case inner end face
20 Hole portion
21 Dividing wall
22 Seal lip

DETAILED DESCRIPTION INCLUDING BEST MODE FOR CARRYING OUT THE INVENTION

A preferred embodiment of the present invention is explained below by reference to the attached drawings.

Embodiment 1

First, in FIG. 1, a door D is pivotably mounted on an automobile body B via a hinge H so as to open and close its entrance, and a door checker C of the present invention is mounted on the door D between the body B and the door D.

As shown in FIG. 1 to FIG. 4, the door checker C has a case 1 secured to an inner face of an end wall of the door D. This case 1 is formed from a box-shaped case main body 1*a* having one end open and a cover 1*b* joined to the case main body 1*a* via swage portions 11 and 11 (see FIG. 4) while covering the open end, and the case main body 1*a* and the cover 1*b* are secured to the end wall of the door D by means of a pair of upper and lower bolts 2 and 2 so that the cover 1*b* abuts against the inner face of the end wall. The cover 1*b* and the case main body 1*a* are provided with through holes 4 and 5 arranged coaxially with a through hole 3 opening in the end wall of the door D, a base end of a check plate 6 running through these three through holes 3, 4, and 5 is coupled to a bracket 7 via a pivot 8 so that they are mutually pivotable, and this bracket 7 is secured to the body B via a bolt 9 so that the pivot 8 is disposed parallel to the pivot axis of the hinge H. The check plate 6 is disposed substantially horizontally, and upper and lower faces thereof serve as detent faces 10 and 10.

The check plate 6 is formed from a steel plate main body 6*a* directly coupled to the bracket 7 and disposed substantially horizontally and a synthetic resin covering body 6*b* mold-bonded to a peripheral face of the plate main body 6*a* apart from at opposite ends. The covering body 6*b* is formed so that a gap between the upper and lower detent faces 10 and 10 of the check plate 6 gradually increases from the base end side (the bracket 7 side) toward the free end side of the plate 6, a half-open detent notch 10*a* is formed in a longitudinally middle section of the detent faces 10 and 10, a fully-open detent notch 10*b* is formed in the vicinity of the free end portion, and a fully-open stopper 12 adjacent to the fully-open detent notch 10*b* is attached to the plate main body 6*a*. This fully-open stopper 12 is formed from a steel stopper plate 14 secured to the plate main body 6*a* via a pin 13 and a stopper rubber 15 mounted on the stopper plate 14 and facing the fully-open detent notch 10*b*, and a large number of cushion projections 15*a* protrude from an end face of the stopper rubber 15 facing the fully-open detent notch 10*b*. The width of the check plate 6 is substantially constant apart from opposite ends thereof.

In FIG. 2 to FIG. 5, a pair of upper and lower synthetic resin detent members 16 and 16 are fitted into and retained by the case 1 so that they can slide along the plate thickness direction of the check plate 6, the detent members 16 and 16 retaining the door D at a predetermined open position in cooperation with the pair of detent faces 10 and 10 of the check plate 6. These detent members 16 and 16 include a semi-cylindrical engagement portion 16*a* that can engage with the half-open detent notch 10*a* and the fully-open detent notch 10*b*. Furthermore, the two detent members 16 and 16 include guide walls 16*b* and 16*b* slidably supporting opposite side faces in the fore-and-aft direction of the check plate 6 in cooperation with each other.

Moreover, housing chambers 18 and 18 are defined in the interior of the case 1 between outer end faces 18*a* of the detent members 16 and 16 on the side opposite to the check plate 6 and upper and lower inner end faces 18*b* of the case 1 facing the outer end faces 18*a*, and a pair of upper and lower resilient members 17 and 17 are fitted in a compressed state into the housing chambers 18 and 18, the resilient members 17 and 17 resiliently urging the detent members 16 and 16 against the detent faces 10 and 10 of the check plate 6.

Each resilient member 17 is formed from a resilient material such as an elastomer so that the housing chamber 18 is substantially filled therewith and one half of the resilient member 17 on the outer end face 18*a* side of the detent member 16 and the other half on the inner end face 18*b* side of the case 1 are symmetrical. Furthermore, each resilient member 17 is formed so that a left half on the left inside face side of the case 1 and a right half on the right inside face side of the case 1 are symmetrical.

In the case of the illustrated example, a pair of extension walls 16*c* and 16*c* are projectingly provided on opposite end portions of the outer end face 18*a* of each detent member 16 for lengthening the sliding span of the detent member 16 relative to the two inner faces of the case 1, and in order to receive these extension walls 16*c* and 16*c* a pair of steps 17*a* and 17*a* descending by one step are formed on opposite end portions of the resilient member 17. In order to obtain the above-mentioned symmetrical shape, a pair of steps 17*a* and 17*a* are also provided on the end face of the resilient member 17 on the inner end face 18*b* side of the case 1.

Furthermore, each resilient member 17 is provided with a circular cross-section hole portion 20 opening on upper and lower end faces and allowing resilient deformation of the resilient member 17, and the hole portion 20 is divided by a dividing wall 21 integral with the resilient member 17 into two portions 20 and 20 that are blocked from each other. Moreover, annular seal lips 22 and 22 surrounding the open ends of the hole portions 20 and 20 are integrally and projectingly provided on upper and lower end faces of the resilient member 17, and the hole portions 20 and 20 are sealed by the outer end face 18*a* of the detent member 16 and the upper and lower inner end faces 18*b* of the case 1 coming into intimate contact with the seal lips 22 and 22.

The operation of this embodiment is now explained.

When the door D is opened from a closed state, since the engagement portions 16*a* and 16*a* of the detent members 16 and 16 slide in response thereto so as to ascend the detent faces 10 and 10 of the check plate 6, and the resilient members 17 and 17 are compressed accompanying this, due to an increase in the resilient force a pressure contact force against the detent faces 10 and 10 of the detent members 16 and 16 increases, and an opening torque for the door D increases appropriately.

When the door D is opened to a predetermined half-open position, since the engagement portions 16*a* and 16*a* of the detent members 16 and 16 drop into the half-open detent notches 10*a* and 10*a* of the check plate 6 due to the resilient force of the resilient members 17 and 17, the opening torque for the door D rapidly increases, thereby retaining the door D at the predetermined half-open position.

Furthermore, when the engagement portions 16*a* and 16*a* of the detent members 16 and 16 are pulled out from the half-open detent notches 10*a* and 10*a* by applying a further opening force to the door D, and the door D is opened to a predetermined fully-open position, in this case the engagement portions 16*a* and 16*a* drop into the fully-open detent notches 10*b* and 10*b* and at the same time the case 1 is resiliently received by the stopper rubber 15, thereby retaining the door D at the fully-open position.

Furthermore, in the course of the door D being closed from the fully-open position, in the same manner as above the door D can be retained at the predetermined half-open position due to engagement between the engagement portions 16*a* and 16*a* of the detent members 16 and 16 and the half-open detent notches 10*a* and 10*a* and, moreover, when further closing the door D, since the engagement portions 16*a* and 16*a* of the detent members 16 and 16 slide so as to descend the detent faces 10 and 10 of the check plate 6, a closing torque for the door D decreases appropriately, thus enabling the closing to be carried out with little effort.

In this process, the detent members 16 and 16 slide vertically within the case 1 in response to them ascending and descending on the detent faces 10 and 10 and engaging with and disengaging from the detent notches 10*a* and 10*b*; 10*a* and 10*b*, the resilient members 17 and 17 accordingly repeatedly undergo resilient deformation, that is, compression and expansion, and the resilient deformation is allowed by a change in volume of the hole portion 20 of each of the resilient members 17.

Since the resilient member 17 is formed so that it substantially fills the housing chamber 18 within the case 1, it is possible to prevent as far as possible rainwater from infiltrating into the housing chamber 18. Moreover, since the resilient member 17 has the hole portion 20, which is sealed by the outer end face 18*a* of the detent member 16 and the inner end face of the case 1, even if some rainwater infiltrates into the housing chamber 18 and freezes, the hole portion 20 allows resilient deformation of the resilient member 17 as normal, and the resilient deformation characteristics of the resilient member 17 do not change, thus always maintaining a good opening and closing feel for the door D.

In particular, since the hole portion 20 is divided into two portions 20 and 20 blocked from each other via the dividing wall 21 integral with the resilient member 17, even if rainwater infiltrates into one half of the hole portion 20 and freezes, resilient deformation of the resilient member 17 can be allowed by the other half of the hole portion 20, which is free from the infiltration of rainwater, thus enhancing the reliability.

Furthermore, since the annular seal lips 22 and 22 are formed on the outer face of the resilient member 17, the annular seal lips 22 and 22 surrounding the open end of the hole portion 20 and being in intimate contact with the outer end face 18*a* and the inner end face 18*b*, it is possible to reliably prevent rainwater from infiltrating into the hole portion 20, thus further enhancing the reliability. Moreover, since the hole portion 20 opens on the outer face of the resilient member 17, this can easily be formed by means of a mold when molding the resilient member 17.

Furthermore, since the hole portion 20 of the resilient member 17 has a circular cross-section, stress occurring on the inner peripheral wall of the hole portion 20 when the resilient member 17 is compressed and deformed can be equalized, thus contributing to an improvement in the durability of the resilient member 17.

Moreover, since the resilient member 17 is formed so that a half on the side in which it is in intimate contact with the outer end face 18*a* and the other half on the side in which it is intimate contact with the inner end face 18*b* are symmetrical and, furthermore, a left half on the left inside face side of the case 1 and a right half on the right inside face side of the case 1 are symmetrical, it is unnecessary to restrict the direction of the resilient member 17 with respect to the outer end face 18*a* and the inner end face 18*b* in either the vertical direction or the lateral direction when fitting the resilient member 17 into the housing chamber 18, the ease of assembly is good, and it is consequently possible to not only avoid misassembly but also for the proper function of the resilient member 17 to be always exhibited.

The present invention is not limited to the above-mentioned embodiment, and may be modified in a variety of ways as long as the modifications do not depart from the spirit and scope thereof. For example, when the detent member 16 does not have the extension walls 16*c* and 16*c*, the resilient member 17 may be formed with a simple rectangular cross-sectional shape without the steps 17*a* and 17*a*.

The invention claimed is:

1. An automobile door checker comprising a case secured to one of an automobile body and a door pivotably supported on the automobile body, a check plate that runs movably through the case and is coupled to the other one of the body and the door, a detent member slidably fitted into and retained by the case so as to retain the door at a predetermined open position in cooperation with a detent face of the check plate, and a resilient member that is made of a resilient material, is provided in a compressed state in a housing chamber defined between an outer end face of the detent member on a side opposite to the check plate and an inner end face of the case opposite the outer end face, and generates a detent force between the detent member and the detent face, wherein the resilient member is formed so as to substantially fill the housing chamber, the resilient member is provided with a hole portion that allows resilient deformation of the resilient member, the hole portion being sealed by the outer end face and the inner end face, and one half of the resilient member on the outer end face side and the other half on the inner end face side are symmetrical, wherein annular seal lips are formed on an outer face of the resilient member, the annular seal lips surrounding an open end of the hole portion and being in intimate contact with the outer end face and the inner end face.

2. The automobile door checker according to claim 1, wherein the resilient member is provided with a dividing wall for dividing the hole portion into two portions that are blocked from each other.

3. The automobile door checker according to claim 1, wherein the hole portion is formed so as to have a circular cross-section.

4. The automobile door checker according to claim 1, wherein a left half of the resilient member on a left inside face side of the case and a right half on a right inside face side of the case are symmetrical.

* * * * *